United States Patent [19]

Di Marco et al.

[11] 4,409,573

[45] Oct. 11, 1983

[54] ELECTROMAGNETICALLY ACTUATED ANTI-REBOUND LATCH

[75] Inventors: Bernard Di Marco, Bellefontaine; Andrew J. Kralik, Marysville, both of Ohio

[73] Assignee: Siemens-Allis, Inc., Atlanta, Ga.

[21] Appl. No.: 257,305

[22] Filed: Apr. 23, 1981

[51] Int. Cl.[3] ..... H01H 77/10

[52] U.S. Cl. ..... 335/16; 335/46; 335/195

[58] Field of Search ..... 335/195, 16, 147, 46

[56] References Cited

U.S. PATENT DOCUMENTS 3,815,059 6/1974 Spoelman ..... 335/16

4,071,836 1/1981 Cook et al. ..... 335/195

4,144,513 3/1979 Shaffer et al. ..... 335/16

*Primary Examiner*—Harold Broome

*Attorney, Agent, or Firm*—Frederick W. Powers, III

[57] ABSTRACT

An improved anti-rebound mechanism for circuit breakers having a blow-off, current-limiting feature is provided. The improvement consists of a ferromagnetic latch which is activated by any massive current surge through the circuit breaker sufficient to cause blow-off current interruption. The latch is caused to be magnetically attracted to, and engage with, a notch on a movable arm of a circuit breaker to maintain the arm in an open position until the circuit breaker is manually reset in a closed position.

25 Claims, 9 Drawing Figures

ELECTROMAGNETICALLY ACTUATED ANTI-REBOUND LATCH

BACKGROUND OF THE INVENTION

A. Field of the Invention

The present invention relates generally to magnetically activated latches and more specifically to molded-case circuit breaker devices having current-limiting blow-off characteristics equipped with anti-rebound mechanisms.

B. Description of the Prior Art

In the field of electrical circuit breaker technology, it is frequently necessary to provide a circuit breaker that is responsive to a specific type of current overload abnormality. There are three basic types of current interruption mechanisms—thermal, electromagnetic, and blow-off-type mechanisms. For example, a circuit breaker may be designed to automatically trip open after a relatively long period of moderate current overload through the breaker. Such a circuit breaker typically will have a bimetallic thermal element in it which gradually heats due to the moderate overload current to bend the bimetallic element and eventually cause a circuit breaker to trip open. Such circuit breakers are useful in handling moderate current overloads of 100% to 500% of the rated load of the breaker.

Other current interruption mechanisms known as instantaneous trip breakers are used to handle situations in which the current overload is on the order of 500% to 600% of the rated current of the breaker. This type of circuit breaker is typically a magnetic mechanism which reacts in a matter of milliseconds to excessive current overloads. Such a circuit breaker may either automatically reset or require manual reclosing after the excessive current has subsided.

Yet another type of current interrupting mechanism commonly called a blow-off mechanism is commonly used to handle massive overcurrent conditions and instantaneously open during the first milliseconds that a massive overcurrent condition exists. An example of a current-limiting, blow-off-type mechanism is described in U.S. Pat. No. 4,071,836 to Cook et al.

In the event of a massive overcurrent condition, it is imperative to instantaneously open the circuit breaker contacts because any delay in opening allows excessive currents to flow through the electrical contacts of the circuit breaker which may cause the contacts to separate and then reclose and fuse together, thereby permanently preventing the contacts from being opened. Arcing between circuit breaker contacts during opening may further cause instantaneous heating of the electrical contacts so that it is undesirable to allow the circuit breaker to reclose immediately after the massive overcurrent has subsided because the contacts may still be hot enough for unwanted fusing to occur. Thus, it is desirable to provide an anti-rebound mechanism to prevent automatic reclosing of blow-off-type mechanisms. An example of a typical anti-rebound mechanism is described in U.S. Pat. No. 4,144,513 to Shaffer et al. The present device is similar to typical prior art anti-rebound mechanisms in that both involve the use of an anti-rebound latch which is somehow biased toward a contact arm to move the latch into a notch in the contact arm when a contact arm of the circuit breaker is blown off by electrodynamic forces. The prior art, however, as exemplified by Shaffer et al. uses a biasing spring to exert a constant pressure on the latch at all times. In the particular device described in the Shaffer patent, as the contact arm is blown open, a camming surface at one end of the contact arm engages an anti-rebound latch pin forcing it against the force of a biasing spring. Once an upper end of the camming surface moves below the pin, the force of the biasing spring moves the pin into a notch. Cooperation between the pin and the notch locks the contact arm against further movement. The force of the biasing spring in the device described by the Shaffer patent creates unwanted friction between the latch and the contact arm resulting in undesirable wear between the latch and the current-carrying arm during normal operation of the circuit breaker in the absence of excessive current surges. For years, anti-rebound mechanisms have relied on a spring-type biasing which produces unnecessarily constant forces to engage the anti-rebound mechanism in the event of a massive overcurrent.

SUMMARY OF THE INVENTION

The present invention is an improvement in anti-rebound mechanisms for circuit breakers having blow-off mechanisms. Each pole of the present circuit breaker switch includes first and second electrically conductive arms equipped with respective first and second electrical contact pads at one end thereof. The present invention further includes means for moving the second arm between a closed position in which the contact pads are engaged to allow current to flow between the first and second arms and an open position in which the contacts are disengaged to prevent current from flowing between the arms. A magnetically activated blow-off means for forcing the second arm to an intermediate-open position in the event of a massive overcurrent is also included. Advantage is taken of the naturally induced flux in the circuit breaker moving means to create a magnetically activated latch for maintaining the second arm in the intermediate-open position when excessive current conditions exist. The means for moving the second arm from a closed to an open position includes a generally U-shaped guide means which surrounds the second arm and is generally disposed toward one end thereof. The latch of the present invention is made of a ferromagnetic material and abuts opposite ends of the generally U-shaped guide means. In the event of an excessive current surge through the circuit breaker, the U-shaped guide means together with the subject latch form an essentially closed electromagnetic loop. This causes the latch to be instantaneously attracted toward the second arm by a relatively strong electromagnetic force. The latch is equipped with an outwardly extending protrusion at one end thereof which engages a notch in the second electrically conductive contact arm as the arm swings to the intermediate-open position upon the introduction of an excessive current through the circuit breaker. The U-shaped guide means is further equipped with camming surfaces to release the latch and permit later reclosing of the circuit breaker.

An object of the present invention is to provide an anti-rebound mechanism which does not produce undesirable friction or unnecessary biasing force against a movable arm of the circuit breaker when massive overcurrent is not present in the breaker.

A further object of the present invention is to provide an anti-rebound mechanism which is relatively inexpensive to manufacture.

Another object of the present invention is to provide a highly reliable anti-rebound mechanism which is not subject to unnecessary wear during the life of the circuit breaker.

Yet still another object of the subject development is to provide an anti-rebound mechanism for a circuit breaker having a blow-off mechanism wherein the mechanism is magnetically activated by excessive current surges through the breaker.

Other objects, advantages, and novel features of the present invention will become apparent from the following detailed description of the invention when considered in conjunction with the accompanying drawings.

Figure 3:
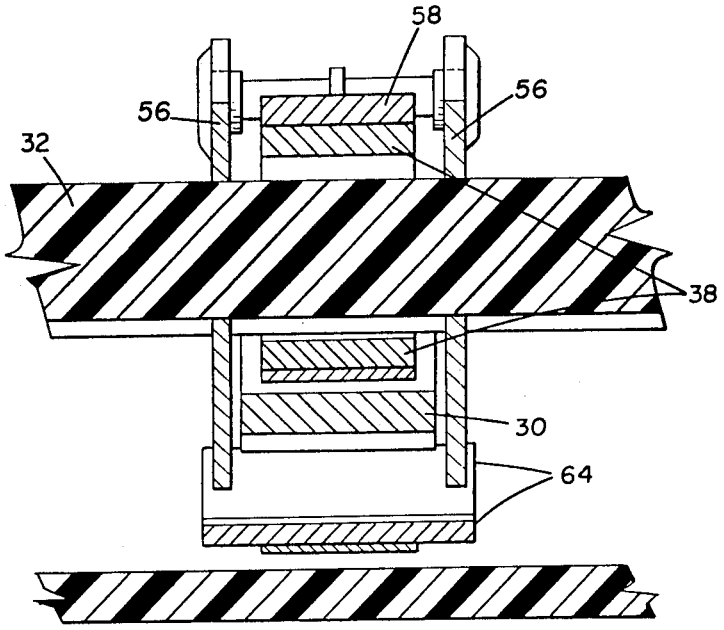

FIGS. *2a–c* are partially phantom, side elevation views of a circuit breaker illustrating the relative disposition of the subject anti-rebound mechanism when the circuit breaker is in closed, intermediate-open, and fully open positions;

FIG. 3 is a cross-sectional illustration of the subject latch and circuit breaker taken along the lines A—A of FIG. *2b;*

Figure 5:
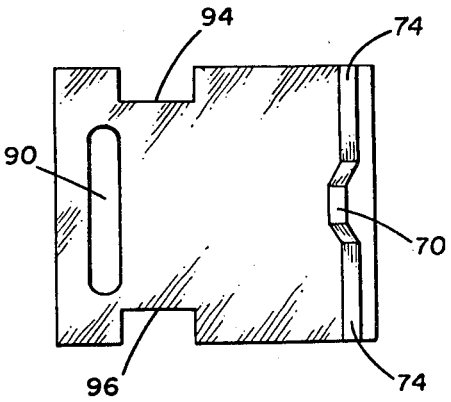
Figure 7:
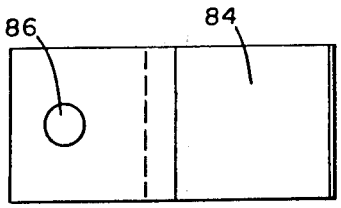
Figure 4:
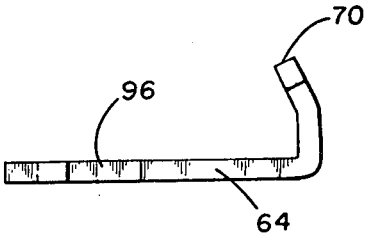
Figure 6:
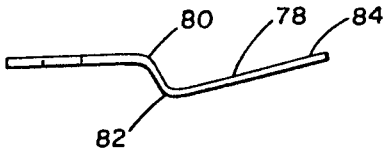

FIG. 4 is a side elevation of the preferred embodiment of the subject latch;

FIG. 5 is a plan view of the preferred embodiment of the subject latch;

FIG. 6 is a side elevation of a biasing spring employed in the preferred embodiment; and FIG. 7 is a plan view of the biasing spring of FIG. 6.

DETAILED DESCRIPTION OF THE PREFERRED EMBODIMENT

Figure 1:
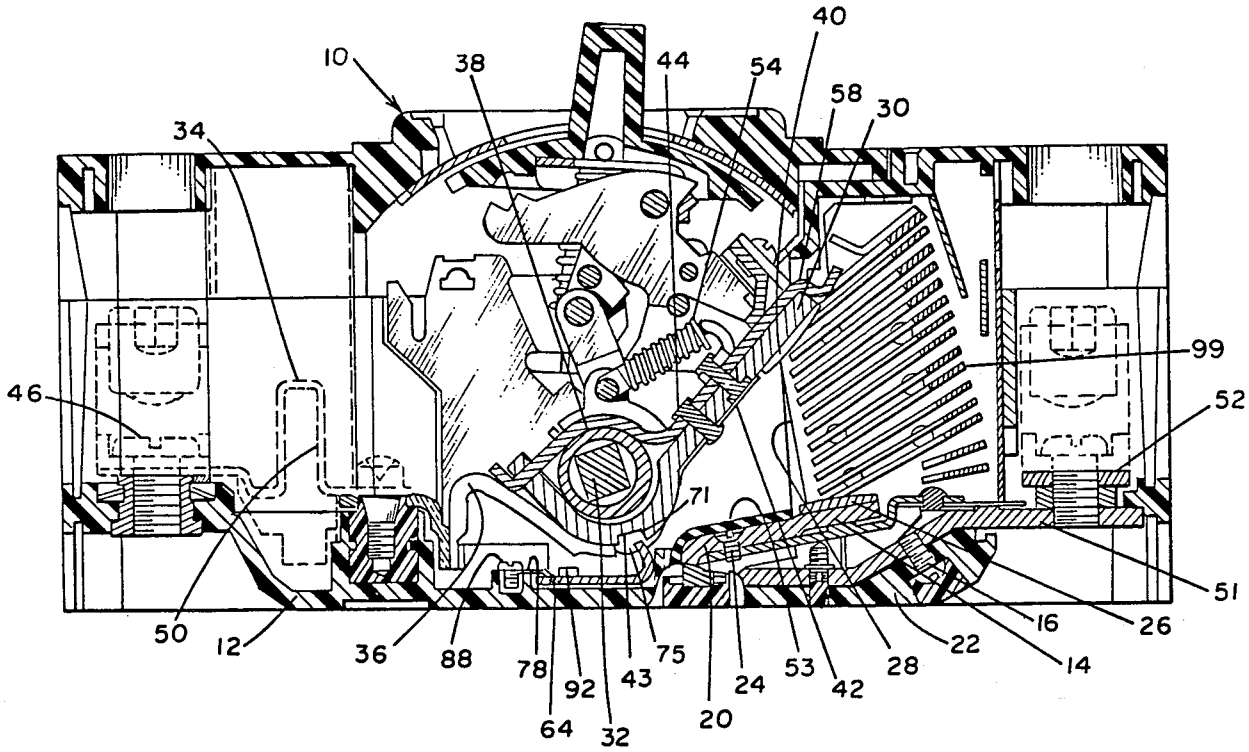
FIG. 1 is a somewhat fragmentary section of one pole of a three-pole circuit breaker having blow-off contacts including the anti-rebound mechanism of the subject disclosure.

Referring to FIG. 1, one pole of a three-pole circuit breaker designated generally as 10 is illustrated. Each pole of the circuit breaker is substantially identical to the one illustrated in FIG. 1 and therefore only brief elaboration of the other two poles is required herein. The circuit breaker 10 includes a molded insulated housing 12. A first electrically conductive arm 14 is provided within the housing 12. The arm 14 is fixedly attached to the base of the housing by a screw 16. The first electrically conductive arm 14 has a generally U-shaped configuration with one leg of the "U" extending along the base portion 22 of the housing. The electrically conductive arm 14 is typically made of copper. A silver electrical contact pad 26 may be welded to one end of arm 14. A layer of insulation 28 substantially covers the upper portion of arm 14 exclusive of the portion of arm 14 to which contact pad 26 is attached.

A second electrically conductive arm 30 is pivotally mounted about a glass epoxy crossbar 32 which is used to open arm 30 during normal operation as discussed more fully hereinbelow. Arm 30 is electrically attached to connector plate 34 by means of copper braid 36. A steel guide ring 38 surrounds crossbar 32 to allow movement of conduction arm 30 to an intermediate-open position without requiring rotation of crossbar 32 in the event of a massive overcurrent. Conduction arm 30 is typically made of copper and is equipped with a second electrical contact pad 40 made of silver welded to the free end of the underside of the arm. A thin layer of insulative material 42 also is mounted on the underside of conduction arm 30 by means of a rivet 44. As can be seen in FIGS. *2a–c* the second arm 30 is pivotable about crossbar 32 and may be disposed in a closed or "on" position (FIG. *2a*) in which first and second electrical contacts 26 and 40 are engaged. In this position, current may flow through arms 30 and 14 in a path defined by terminal 46, conduction strap 50, connector plate 34, copper braid 36, second conduction arm 30, second silver contact pad 40, first silver contact pad 26, first conduction arm 14, and second terminal 52 in the base of the housing. As previously noted, FIG. 1 illustrates only one pole of a three-pole circuit breaker. The other two poles of the circuit breaker conduct electricity therethrough in an identical manner and are all connected to crossbar 32 to facilitate opening and closing of all three poles of the circuit breaker in unison under normal operating conditions. Each pole of the circuit breaker is provided with individual parallel plate arc chutes 99 to facilitate extinction of arcs drawn between contact pads 26, 40 upon separation thereof.

Figure 2A:
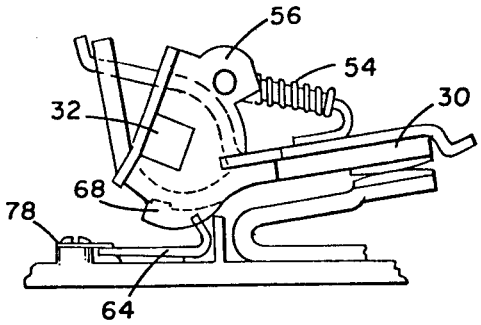

Referring now again to FIG. 2, arm 30 is biased in a closed position (FIG. *2a*) by a pair of compression springs 54 (only one shown). When current through the circuit breaker exceeds a predetermined amount, electrically induced flux about arms 14 and 30 creates sufficient repulsive forces to overcome biasing of compression springs 54 to force arm 30 to an intermediate, blow-off position as illustrated in FIG. *2b*. It should be noted that during blow-off the crossbar 32 does not move and each pole of the circuit breaker acts independently to move arm 30 to the intermediate-open position. To open all three poles of a circuit breaker to the fully open position, crossbar 32 is pivoted to rotate attached guide plates 56 (only one shown) on either side of each movable arm of each pole of the circuit breaker. The upper surface of arm 30 is covered with a steel support plate or strap 58. The steel plate is equipped with a pair of outwardly extending, elbowed arms 60 which become engaged with mating extension 62 on each guide plate 56. Thus, as crossbar 32 is pivoted, guide plate 56 is rotated and extension 62 is caused to engage outwardly extending, elbowed arms 60 to cause arm 30 to be moved to the fully open position as illustrated in FIG. *2c*.

As can best be seen in FIG. 1, steel strap 58 extends generally from one end of arm 30 to the other. The subject invention comprehends that steel strap 58 and guide plate 56 on either side of each pole of the circuit breaker may be used in combination with an anti-rebound latch 64 to create an electromagnetic environment about arm 30 when excessive current flows through arm 30 sufficient to cause blow-off to occur. Thus, it is necessary that the latch be made of steel or other ferromagnetic material. Steel ring 38 which surrounds crossbar 32 greatly enhances this magnetic effect.

As best illustrated in FIG. 3, as electrical current surges through arm 30, increased flux is resultingly induced in guide plates 56, 56 strap 58, steel ring 38, and latch 64. Flux induced in latch 64 creates a magnetic attraction between the latch 64 and arm 30. Under normal operating conditions, current through the circuit breaker creates only a nominal attraction between latch 64 and arm 30. However, when excessive current surges sufficiently to cause blow-off, the magnetic attraction between latch 64 and arm 30 is greatly increased.

Figure 2B:
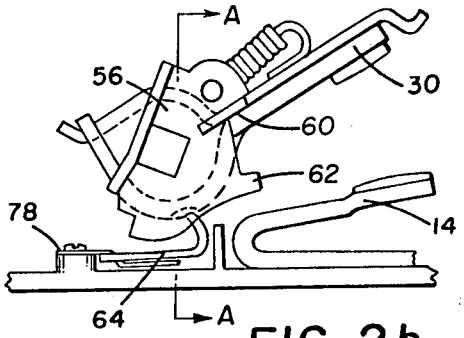
Figure 2C:
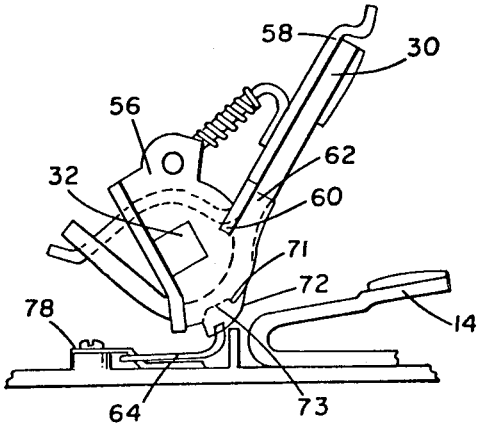

Referring once again to FIG. 2, arm 30 is provided with a notch 68 for engagement with latch 64 upon blow-off of the circuit breaker (FIG. 2*b*). As best seen in FIGS. 4 and 5, latch 64 has a generally J-shaped configuration. The curved end of the "J" is equipped with an outwardly extending protrusion 70 which is received by notch 68 during blow-off engagement.

The notch 43, 71 and 68 in the preferred embodiment is a simple rectangularly-shaped groove extending across a portion of the movable arm from one side to another as illustrated in FIG. 1. In another embodiment (illustrated in FIGS. 2*a–c*), the notch may have a first portion 71 which extends normally inwardly across the arm. A recessed portion 73 may also be provided which extends generally parallel to the outer surface of the arm. One edge of the recessed portion is adjacent to the first portion 71, and the other edge of recessed portion 73 is adjacent to a chamfered portion 75 extending across the arm. The chamfered portion together with first portion 71 permit communication between the outer surface of the arm and the recessed portion. If the first portion 71 is disposed on arm 30 closest to the contact pad 40 and the chamfered portion 75 is disposed away from pad 40, then the first edge together with the latch will prevent arm 30 from immediately returning to the closed portion from the intermediate-open position. Conversely, the chamfered edge will facilitate removal of latch 64 from the notch by acting as a camming surface as arm 30 is rotated by crossbar 32 to a fully opened position. Thus, in the preferred embodiment, after blow-off engagement has occurred, arm 30 may not be returned to the closed position until crossbar 32 has been pivoted to first raise arm 30 to a fully opened position.

Camming surface 72 on each guide plate 56 engages outer-recessed edge 74 of the latch as the crossbar 32 rotates guide plate 56 to raise arm 30 to the open position. Accordingly, as the circuit breaker is fully opened, latch 64 is depressed and disengaged from notch 68. A compression spring 54 mounted from guide plate and extending to the second strap 58 creates a biasing force on arm 30 to maintain arm 30 in the closed position. By slightly rotating crossbar 32 to move arm 30 toward the closed direction, compression spring 54 is allowed to cause arm 30 to snap shut while camming surface 72 prevents the outward protrusion of the latch 64 from re-engaging notch 68 during closure.

It may be desirable to gently bias the latch toward arm 30 when no magnetically induced attractive forces between latch 64 and arm 30 are present so as to maintain the latch in a close relationship with the arm without undue friction therebetween. Accordingly, in the preferred embodiment, a leaf spring 78 is provided to bias the latch toward arm 30. The force induced on the latch by leaf spring 78 is several orders of magnitude smaller than the electromagnetically induced force on the latch during excessive current surges. The main purpose of the leaf spring is to reduce the amount of travel required of the latch to engage notch 68 during blowoff. Thus it will be obvious to those skilled in the art that a variety of maintaining means could be used for positioning latch 64 in a close relationship with arm 30.

The leaf spring is illustrated in detail in FIGS. 6 and 7. Very basically, the leaf spring can be described as an elongated sheet of spring steel which has been hardened and drawn after forming. As can best be seen in FIG. 6, the spring has a pair of centrally disposed, oppositely facing angular bends 80 and 82 which extend from one side of the spring to the other to create a support platform 84 at one end of a spring, upon which latch 64 may rest. The spring is equipped with a mounting means which in the preferred embodiment is merely a receiving aperture 86 centrally disposed through the opposite end of the spring. As illustrated in FIG. 1, the spring is mounted on housing 12 by a threaded screw 88.

In the preferred embodiment, latch 64 is equipped with an elongated eye 90 (FIG. 5) which generally extends from one side of the latch to the other and is disposed in the vicinity of the end of the straight portion of the J-shaped latch. The eye 90 allows leaf spring 78 to be partially threaded therethrough so that the latch may be supported and maintained in a close position to arm 30 by the leaf spring.

A pair of guide posts 92 are provided on either side of latch 64 to limit travel of the latch to a plane normal to arm 30. In the preferred embodiment, the latch is equipped with a pair of notched indentions 94, 96 (FIG. 5) to receive the guide posts.

The operation of the anti-rebound mechanism of the present invention is very simple. As previously noted, in the event of a massive overcurrent, arms 14 and 30 are constructed so as to cause arm 30 to be electromagnetically repelled from arm 14 and to open to an intermediate position illustrated in FIG. 2*b*. The massive overcurrent which causes arm 30 to move away from arm 14 also magnetically attracts the latch 64 toward arm 30 and engages notch 68 as arm 30 is rotated to an open position. As previously discussed, latch 64 is attracted to arm 30 during massive overcurrents because guide plates 56, 56 together with steel guide ring 38, strap 58 and latch 64, create an electromagnetic environment about arm 30. The increase in flux induced in the electromagnetic environment during massive overcurents creates a very strong attractive force between latch 64 and arm 30. After latch 64 has engaged arm 30, arm 30 may not reclose automatically in the preferred embodiment. In order to reclose arm 30, crossbar 32 must be rotated to, in turn, rotate guide plates 56, 56 having at least one camming surface 72 (FIG. 2*c*) to engage edge 74 of latch 64 to release latch 64 from notch 68 as arm 30 is rotated by crossbar 32 to a fully opened position. Crossbar 32 may then be rotated in the opposite direction to allow arm 30 to reclose.

Advantage of the present invention over the prior art include the feature that the anti-rebound mechanism of the present invention is relatively inexpensive and simple to manufacture. The present latch represents a significant improvement over the prior art because it greatly reduces unwanted friction between the anti-rebound means and the circuit breaker in the absence of excessive power surges. The present invention is unique in that it relies on electromagnetically induced flux about the current-carrying arms of the circuit breaker to instantaneously induce a very strong attractive force between the anti-rebound mechanism and the circuit breaker whenever a massive overcurrent through the circuit breaker occurs.

Although the invention has been described and illustrated in detail, it is to be clearly understood that the same is by way of illustration and example only and is not to be taken by way of limitation, the spirit and scope of this invention being limited only by the terms of the appended claims.

We claim:

1. A circuit breaker comprising:

a first electrically conductive arm equipped with a first electrical contact at one end thereof;

a second electrically conductive arm equipped with a second electrical contact at one end thereof, said second arm movable from a closed position wherein said contacts are engaged to allow current to flow between said contacts to said arms and to an open position wherein said contacts are disengaged to prevent current from flowing between said first and second arms, said first and second arms being operatively positioned so that electrodynamic forces generated by current flowing in said arms and acting therebetween will move said second arm from said closed to said open position when the current through said contacts exceeds a predetermined amount; and magnetically activated means for operatively engaging said second arm to maintain said second arm in said open position after said second arm has been moved by said electrodynamic forces said magnetically activated means being mounted for movement independent of movement by said second arm and being activated by the flow of current in said second arm.

2. A circuit breaker as recited in claim 1 wherein said magnetically activated means includes a latch.

3. A circuit breaker as recited in claim 2 wherein said latch is made from a ferromagnetic material.

4. A circuit breaker as recited in claim 3 wherein said second arm further includes an inwardly spaced notch to receive said latch.

5. A circuit breaker as recited in claim 4 wherein said latch has a J-shaped configuration.

6. A circuit breaker as recited in claim 1 wherein said second arm is disposed within a generally U-shaped ferromagnetic guide means, said maintaining means being disposed substantially across the open end of said U-shaped means to create an electromagnetic environment about said second arm thereby enhancing flux retention in said magnetically activated means.

7. A circuit breaker as recited in claim 6 wherein said maintaining means includes a ferromagnetic latch forcefully engagable with said second arm upon magnetic activation.

8. A circuit breaker as recited in claim 7 wherein said latch has a J-shaped configuration terminating in an outwardly extending protrusion at the curved portion thereof, and said second arm has an inwardly extending indention therein to engagably receive said protrusion when said maintaining means is activated, said engagement preventing said second arm from returning directly to a closed position.

9. A circuit breaker as recited in claim 8 further including a leaf spring for biasing said protrusion toward said second arm, wherein said force during engagement by magnetic actuation is orders of magnitude greater than the biasing force of said leaf spring.

10. A circuit breaker as recited in claim 9 wherein said latch is formed of steel.

11. A circuit breaker as recited in claim 10 wherein said leaf spring is formed of steel.

12. A circuit breaker comprising:

a housing;

a first electrically conductive arm within said housing, a second electrically conductive arm within said housing, said second arm movable from a closed position to allow current to flow between said first and second arms, to an open position to prevent current from flowing therebetween;

said first arm being fixedly attached to the base of the housing, said first arm having a generally U-shaped configuration with one leg of the U-shaped arm extending along the base of the housing and the other leg of the U-shaped arm is in close confronting relationship to said second arm when the latter is in said closed position whereby current flows in opposite directions through the other leg and the second arm to generate electrodynamic forces tending to move said second arm away from the other leg;

said electrodynamic forces being of sufficient magnitude to cause said second arm to pivot from the closed position to an intermediate-open position, when current through said first and second arms exceeds a predetermined amount; and magnetically activated means to prevent said second arm from rebounding to said open position after said second arm has been moved by electrodynamic forces generated by current exceeding a predetermined amount, said magnetically activated means being mounted for movement independent of movement by said second arm and being activated by the flow of current through said second arm.

13. The circuit breaker as recited in claim 12 wherein said magnetically activated means includes a ferromagnetic latch which is instantaneously attracted toward said second arm by excess current through said first and second arms, and said second arm is equipped with a notch to receive a portion of said latch whereby said latch maintains said arm in the intermediate-open position once excessive current conditions occur.

14. The circuit breaker as recited in claim 13 wherein said latch is equipped with an outwardly extending protrusion at one end thereof for engagement in said notch.

15. The circuit breaker as recited in claim 13 wherein said pivot means includes a crossbar and a pair of guide plates on either side of said second arm, said guide plates being fixedly attached to said crossbar; said second arm being equipped with a support plate having a pair of outwardly extending elbowed arms on each side thereof for fixed engagement with the guide plates as said crossbar is rotated whereby said second arm is pivotable between said closed and open positions by rotation of said crossbar.

16. The circuit breaker as recited in claim 13 wherein said magnetically activated means is activated by excess current through said second arm.

17. The circuit breaker as recited in claim 15 wherein said latch has a generally J-shaped configuration.

18. The circuit breaker as recited in claim 17 wherein said J-shaped latch has an outwardly extending protrusion at the end of the curved portion thereof for engagement with said notch when current through said first and second arms exceeds a predetermined amount.

19. The circuit breaker as recited in claim 18 further comprising a compression spring between said guide plates and said support plate creates a bias on said second arm to maintain said second arm in said closed position.

20. The circuit breaker as recited in claim 18 further comprising a leaf spring to bias said latch toward said second arm so as to maintain said latch in a close relationship with said arm.

21. The circuit breaker as recited in claim 20 wherein said leaf spring comprises an elongated sheet of spring steel having a pair of centrally disposed, oppositely facing angular bends to create a support platform at one end of said spring for supporting said latch.

22. The circuit breaker as recited in claim 21 wherein said latch further includes an elongated eye which generally extends from one side of the latch to the other and is disposed in the vicinity of the end of the straight portion of the J-shaped latch, said eye being provided to allow said leaf spring to be partially threaded therethrough so that said latch may be supported and maintained in a close position to said second arm by said leaf spring.

23. The circuit breaker as recited in claim 22 further comprising a pair of guide posts, one post being on either side of said latch to limit travel of said latch to a plane normal to said second arm, said latch further including a pair of notched indentions, one on each side of said latch to receive said guide posts.

24. A circuit breaker as recited in claim 1 wherein with said contacts engaged substantial lengths of said first and second arms confront one another and are in relatively close proximity whereby with current through said contacts in excess of said predetermined amount current flows in opposite directions through said lengths to generate an electrodynamic force of sufficient magnitude to move said second arm toward said open position.

25. A circuit breaker as recited in claim 1 also comprising a mechanical operating mechanism operatively connected to said second arm for selectively opening and closing said contacts.

* * * * *